US010751784B2

(12) United States Patent
Dunwoody et al.

(10) Patent No.: US 10,751,784 B2
(45) **Date of Patent: *Aug. 25, 2020**

(54) HIGH SPEED NECKING CONFIGURATION

(71) Applicant: Crown Packaging Technology, Inc., Alsip, IL (US)

(72) Inventors: Paul Robert Dunwoody, Oxfordshire (GB); Ian K. Scholey, Barnsley (GB)

(73) Assignee: Crown Packaging Technology, Inc., Alsip, IL (US)

( * ) Notice: Subject to any disclaimer, the term of this patent is extended or adjusted under 35 U.S.C. 154(b) by 9 days.

This patent is subject to a terminal disclaimer.

(21) Appl. No.: 15/928,984

(22) Filed: Mar. 22, 2018

(65) Prior Publication Data

US 2018/0207707 A1 Jul. 26, 2018

Related U.S. Application Data

(63) Continuation of application No. 15/088,691, filed on Apr. 1, 2016, now Pat. No. 9,968,982, which is a (Continued)

(51) Int. Cl.
*B21D 51/26* (2006.01)

(52) U.S. Cl.
CPC ..... *B21D 51/2638* (2013.01); *B21D 51/2615* (2013.01); *B21D 51/2692* (2013.01)

(58) Field of Classification Search
CPC ..... B21D 51/2638; B21D 51/2615; B21D 51/2692
See application file for complete search history.

(56) References Cited

U.S. PATENT DOCUMENTS 137,400 A 4/1873 Ahrend
546,631 A 9/1895 White
(Continued)

FOREIGN PATENT DOCUMENTS

CA 2536841 3/2005
CN 2829347 Y 10/2006
(Continued)

OTHER PUBLICATIONS

"Operation, Safety, and Maintenance Manual for the 795K Necker System", Belvac Production Machinery, Inc., Sep. 2004, 143 pages.
(Continued)

*Primary Examiner* — Teresa M Ekiert
(74) *Attorney, Agent, or Firm* — BakerHostetler

(57) ABSTRACT

A horizontal can necking machine assembly includes a plural of main turrets and a plural of transfer starwheels. Each main turret includes a main turret shaft, a main gear mounted on the main turret shaft, a pusher assembly, and a die capable of necking a can body upon actuation of the turret shaft. Each transfer starwheel includes a transfer shaft and a transfer gear mounted on the transfer shaft. The main gears are engaged with the transfer gears such that lines through the main gear center and the centers of opposing transfer gears form an included angle of less than 170 degrees, thereby increasing the angular range available for necking the can body. The main turrets and transfer starwheels may operate to neck and move at least 2800 cans per minute, and each pusher assembly may have a stroke length relative to the die that is at least 1.5 inches.

16 Claims, 9 Drawing Sheets

Related U.S. Application Data continuation of application No. 14/070,954, filed on Nov. 4, 2013, now Pat. No. 9,308,570, which is a continuation of application No. 12/109,176, filed on Apr. 24, 2008, now Pat. No. 8,601,843.

(56) References Cited

U.S. PATENT DOCUMENTS 548,888 A 10/1895 Noteman
593,755 A 11/1897 Pond et al.
1,459,584 A 6/1923 Ericsson
1,498,940 A 6/1924 Wheeler
1,621,301 A 3/1927 Wright
2,154,115 A 4/1939 Stehling
2,467,278 A 4/1949 Thompson
2,550,156 A 4/1951 Lyon
2,686,551 A 8/1954 Laxo
2,724,289 A 11/1955 Wight
2,847,051 A 8/1958 Renard
2,874,562 A 2/1959 Cross
2,928,454 A 3/1960 Laxo
2,940,502 A 6/1960 La Martine
3,096,709 A 7/1963 Eldred et al.
3,143,366 A 8/1964 Nichols
3,268,054 A 8/1966 Murphy et al.
3,344,685 A 10/1967 Crouzet
3,374,684 A 3/1968 Greven
3,397,592 A 8/1968 Muller
3,406,648 A 10/1968 Armbruster
3,418,837 A 12/1968 Vanderlaan et al.
3,498,149 A 3/1970 Kundrach
3,599,780 A 8/1971 Sorbie
3,621,530 A 11/1971 Pflieger et al.
3,635,069 A 1/1972 Eickenhorst
3,659,443 A 5/1972 Ball
3,687,098 A 8/1972 Maytag
3,786,957 A 1/1974 Hilgenbrink
3,797,429 A 3/1974 Wolfe
3,812,696 A 5/1974 Kneusel et al.
3,964,412 A 6/1976 Kitsuda
3,983,729 A 10/1976 Traczyk et al.
4,030,432 A 6/1977 Miller et al.
4,098,394 A 7/1978 Stahura
4,164,997 A 8/1979 Mueller
4,246,770 A 1/1981 Franek et al.
4,257,500 A 3/1981 Brunner
4,261,193 A 4/1981 Boik
4,272,977 A 6/1981 Gombas
4,295,552 A 10/1981 Erlach
4,331,014 A 5/1982 Miller et al.
4,341,103 A 7/1982 Escallon et al.
4,446,714 A 5/1984 Cvacho
4,457,160 A 7/1984 Wunsch
4,463,961 A 8/1984 Fernandez
4,513,595 A 4/1985 Cvacho
4,519,232 A 5/1985 Traczyk et al.
4,576,024 A 3/1986 Weber
4,590,788 A 5/1986 Wallis
4,624,098 A 11/1986 Trendel
4,671,093 A 6/1987 Dominico et al.
4,693,108 A 9/1987 Traczyk et al.
4,723,882 A 2/1988 Wissman et al.
4,732,027 A 3/1988 Traczyk et al.
4,760,725 A 8/1988 Halasz
4,773,250 A 9/1988 Miyazaki
4,774,839 A 10/1988 Caleffi et al.
4,808,053 A 2/1989 Nagai et al.
4,817,409 A 4/1989 Bauermeister
4,821,371 A 4/1989 Finkle
4,838,064 A 6/1989 Pass
4,892,184 A 1/1990 Vander Griendt et al.
4,924,107 A 5/1990 Tucker
4,945,954 A 8/1990 Wehrly et al.
4,983,206 A 1/1991 Trunzo
5,105,649 A 4/1992 Hite et al.
5,209,101 A 5/1993 Finzer
5,226,303 A 7/1993 Dieden et al.
5,235,839 A 8/1993 Lee, Jr. et al.
5,245,848 A 9/1993 Lee, Jr. et al.
5,249,449 A 10/1993 Lee et al.
5,282,375 A 2/1994 Lee, Jr. et al.
5,297,414 A 3/1994 Sainz
5,320,469 A 6/1994 Katou et al.
5,349,836 A 9/1994 Lee, Jr.
5,349,837 A 9/1994 Halasz et al.
5,353,619 A 10/1994 Chu et al.
5,355,710 A 10/1994 Diekhoff
5,370,472 A 12/1994 Muellenberg
5,448,903 A 9/1995 Johnson
5,467,628 A 11/1995 Bowlin et al.
5,469,729 A 11/1995 Hager
5,497,900 A 3/1996 Caleffi et al.
5,524,468 A 6/1996 Jentzsch et al.
5,540,320 A 7/1996 Sarto et al.
5,553,826 A 9/1996 Schultz
5,611,231 A 3/1997 Marritt et al.
5,634,364 A 6/1997 Gardner et al.
5,676,006 A 10/1997 Marshall
5,682,786 A 11/1997 Hahn
5,706,686 A 1/1998 Babbitt et al.
5,711,178 A 1/1998 Hogendoorn et al.
5,713,235 A 2/1998 Diekhoff
5,724,848 A 3/1998 Aschberger
5,737,958 A 4/1998 Sainz et al.
5,755,130 A 5/1998 Tung et al.
5,768,932 A 6/1998 Hahn
5,778,723 A 7/1998 Diekhoff
5,782,308 A 7/1998 Latten et al.
5,813,267 A 9/1998 Aschberger et al.
5,832,769 A 11/1998 Schultz
5,882,178 A 3/1999 Hudson et al.
5,906,120 A 5/1999 Thacker et al.
6,032,502 A 3/2000 Halasz et al.
6,032,505 A 3/2000 Stodd
6,055,836 A 5/2000 Waterworth et al.
6,085,563 A 7/2000 Heiberger et al.
6,094,961 A 8/2000 Aschberger
6,164,109 A 12/2000 Bartosch
6,167,743 B1 1/2001 Marritt et al.
6,176,006 B1 1/2001 Milliman
6,178,797 B1 1/2001 Marshall et al.
6,199,420 B1 3/2001 Bartosch
6,240,760 B1 6/2001 Heiberger et al.
6,510,938 B1 1/2003 Bowlin
6,525,333 B1 2/2003 Hooker et al.
6,571,986 B1 6/2003 Simmons
6,637,247 B2 10/2003 Bowlin
6,644,083 B2 11/2003 Pakker
6,658,913 B1 12/2003 Zanzerl et al.
6,661,020 B2 12/2003 Schill et al.
6,672,122 B2 1/2004 Mustread et al.
6,698,265 B1 3/2004 Thomas
6,752,000 B2 6/2004 Reynolds et al.
6,763,752 B2 7/2004 Marshall et al.
6,769,164 B2 8/2004 Zubcevic
6,779,651 B1 8/2004 Linglet et al.
6,971,278 B2 12/2005 Robbins et al.
7,000,445 B2 2/2006 Hepner et al.
7,028,857 B2 4/2006 Peronek
7,069,765 B2 7/2006 Grove et al.
7,073,365 B2 7/2006 Geho et al.
7,100,417 B2 9/2006 Yamanaka et al.
7,140,223 B2 11/2006 Chupak
7,404,309 B2 7/2008 Schill et al.
7,568,573 B2 8/2009 Schill
7,770,425 B2 8/2010 Egerton et al.
7,784,319 B2 8/2010 Saville
7,963,139 B2 6/2011 Shortridge
8,245,551 B2 8/2012 Egerton
8,464,567 B2 6/2013 Saville
2002/0029599 A1 3/2002 Heiberger et al.
2002/0142908 A1 10/2002 Halasz et al.
2002/0148266 A1 10/2002 Heiberger et al.
2004/0069027 A1 4/2004 Fukushima

(56) References Cited

U.S. PATENT DOCUMENTS

| | | | |
|---|---|---|---|
| 2005/0006388 | A1 | 1/2005 | Turner et al. |
| 2005/0193796 | A1 | 9/2005 | Heiberger et al. |
| 2006/0101884 | A1 | 5/2006 | Schill et al. |
| 2006/0101885 | A1 | 5/2006 | Schill et al. |
| 2006/0101889 | A1 | 5/2006 | Schill et al. |
| 2006/0104745 | A1 | 5/2006 | Schill et al. |
| 2007/0227218 | A1 | 10/2007 | Shortridge |
| 2007/0227320 | A1 | 10/2007 | Marshall |
| 2007/0227859 | A1 | 10/2007 | Marshall et al. |
| 2007/0249424 | A1 | 10/2007 | Marshall et al. |
| 2007/0251803 | A1 | 11/2007 | Schill et al. |
| 2007/0266758 | A1 | 11/2007 | Myers et al. |
| 2007/0283544 | A1 | 12/2007 | Schill et al. |
| 2007/0283665 | A1 | 12/2007 | Schill et al. |
| 2008/0034823 | A1 | 2/2008 | Frattini et al. |
| 2008/0199278 | A1 | 8/2008 | Frattini |

FOREIGN PATENT DOCUMENTS

| | | | |
|---|---|---|---|
| CN | 2937661 | Y | 8/2007 |
| DE | 1939623 | | 2/1970 |
| DE | 2037145 | A1 | 3/1971 |
| DE | 10156085 | | 5/2003 |
| EP | 0349521 | | 1/1990 |
| EP | 0537772 | | 4/1993 |
| EP | 0885076 | | 7/2002 |
| FR | 2876305 | | 4/2006 |
| FR | 2881123 | | 7/2006 |
| GB | 725937 | A | 3/1955 |
| GB | 738718 | A | 10/1955 |
| GB | 1075665 | A | 7/1967 |
| GB | 1563249 | A | 3/1980 |
| GB | 1592156 | A | 7/1981 |
| GB | 2173437 | | 10/1986 |
| GB | 189707306 | | 3/1989 |
| JP | 05305373 | | 11/1993 |
| JP | 2002/102968 | | 4/2002 |
| JP | 2003/237752 | | 8/2003 |
| JP | 2003/251424 | | 9/2003 |
| JP | 2003/252321 | | 9/2003 |
| JP | 2003/320432 | | 11/2003 |
| JP | 2004/002557 | | 1/2004 |
| JP | 2004/130386 | | 4/2004 |
| JP | 2004/160468 | | 6/2004 |
| JP | 2004/217305 | | 8/2004 |
| JP | 2005/022663 | | 1/2005 |
| JP | 2006/176140 | | 7/2006 |
| JP | 2006/176183 | | 7/2006 |
| WO | WO 94/12412 | | 6/1994 |
| WO | 9737786 | A1 | 10/1997 |
| WO | WO 97/37786 | | 10/1997 |
| WO | WO 97/49509 | | 12/1997 |
| WO | WO 00/23212 | | 4/2000 |
| WO | 2005061149 | A2 | 7/2005 |
| WO | WO 2006/055185 | | 5/2006 |
| WO | WO 2006/067207 | | 6/2006 |
| WO | WO 2006/067901 | | 6/2006 |
| WO | WO 2006/095215 | | 9/2006 |

OTHER PUBLICATIONS

"Bearing Plate 7 Stage—795", Belvac Production Machinery Inc., DWG No. 2702160, Mar. 30, 2007, 1 page.
"Belvac Production Machinery, Inc's Initial Invalidity Contentions", In the United States District Court for the Western District of Virginia Lynchburg Division, Case No. 6:18-cv-00070, filed Feb. 1, 2019, 809 pages.
"General Arrangement 795 Necker-7N/7-N.R.", Belvac Production Machinery Inc., DWG No. 2702223, Mar. 6, 1996, 3 pages.
"Assy, Transfer Shaft, 795", Belvac Production Machinery Inc., DWG No. 2702318, Jan. 9, 1996, 1 page.
"Assy,—Push Ram, N.R.-795", Belvac Production Machinery Inc., DWG No. 2702892, Mar. 1, 1995, 1 page.
"High Speed Necking System", Belvac Production Machinery, Inc., Sep. 2004, 2 pages.
"595SK Modular System", Belvac Production Machinery, Inc., Feb. 2012, 34 pages.
Belvac Production Machinery, Inc., "795 Necking System Specifications", Ball Engineering Sales Order, Apr. 4, 2002, 10 pages.
"795 Tooling Envelope and Parameters", Belvac Production Machinery, Inc., DWG No. 2002131, May 17, 1994, 1 page.
"Die, Necking Stage 02-13", Belvac Production Machinery, Inc., DWG No. 2002551, May 13, 1997, 1 page.
Belvac Production Machinery, Inc., DWG No. 2701401, Mar. 6, 1996, 2 pages.
"Gear-Turret Drive-795", Belvac Production Machinery, Inc., DWG No. 2702145, Jan. 20, 1994, 1 page.
"Answer, Affirmative Defenses, and Counterclaims of Defendant Belvac Production Machinery, Inc. To Plaintiffs' Original Complaint", In The United States District Court for the Western District of Virginia Lynchburg Division, Case No. 6:18-cv-00070, Aug. 24, 2018, 51 pages.
"Belvac Production Machinery, Inc.'s First Amended Counterclaim", In The United States District Court for the Western District of Virginia Lynchburg Division, Case No. 6:18-cv-00070, Sep. 28, 2018, 39 pages.
"Report on the Filing or Determination of an Action Regarding a Patent or Trademark", Western District of Virginia, Lynchburg Division, Docket No. 6:18CV00070, Jul. 9, 2018, 1 page.
"Complaint for Patent Infringement", In The United States District Court for the Western District of Virginia Lynchburg Division, Case No. 6:18-cv-00070, Jul. 9, 2018, 91 pages.
"The Belvac", Brochure, Belvac Production Machinery, 2018, 2 pages.
"The Belvac the Next Generation Necker", Brochure, Belvac Production Machinery, 2014, 12 pages.
"Can Necking Basics", Belvac Production Machinery, Inc., Latin Can Conference, Cancun, Mexico, Mar. 26, 2009, 19 pages.
Exhibit A-4 Belvac's Invalidity Contentions, Invalidity Chart for U.S. Pat. No. 9,308,570 ("The '570 Patent") U.S. Pat. No. 7,404,309 ("Schill '309"), filed Feb. 1, 2019, 32 pages.
Exhibit A-2 Belvac's Invalidity Contentions, Invalidity Chart for U.S. Pat. No. 9,308,570 ("the '570 Patent") WO 97/37786 to Geoffrey Bowlin (Bowlin '786), filed Feb. 1, 2019, 27 pages.
Exhibit F—Obviousness References for U.S. Pat. No. 7,770,425, filed Feb. 1, 2019, 101 pages.
Exhibit E—Obviousness References for U.S. Pat. No. 9,968,982, filed Feb. 1, 2019, 86 pages.
Exhibit D—Obviousness References for U.S. Pat. No. 9,308,570, filed Feb. 1, 2019, 92 pages.
Exhibit C-6 Belvac's Invalidity Contentions, Invalidity Chart for U.S. Pat. No. 7,770,425 ("the '425 Patent") U.S. Publication No. 2005/0193796 to Joseph M. Heiberger et al. ("Heiberger"), filed Feb. 1, 2019, 15 pages.
Exhibit C-5 Belvac's Invalidity Contentions, Invalidity Chart for U.S. Pat. No. 7,770,425 ("the '425 Patent") U.S. Pat. No. 6,698,265 to Keith A. Thomas ("Thomas"), filed Feb. 1, 2019, 15 pages.
Exhibit C-4 Belvac's Invalidity Contentions, Invalidity Chart for U.S. Pat. No. 7,770,425 ("the '425 Patent") U.S. Pat. No. 7,404,309 ("Schill '309"), filed Feb. 1, 2019, 19 pages.
Exhibit C-2 Belvac's Invalidity Contentions, Invalidity Chart for U.S. Pat. No. 7,770,425 ("the '425 Patent") WO 97/37786 to Geoffrey Bowlin ("Bowlin '786"), filed Feb. 1, 2019, 22 pages.
Exhibit B-6 Belvac's Invalidity Contentions, Invalidity Chart for U.S. Pat. No. 9,968,982 ("the '982 Patent") U.S. Publication No. 2005/0193796 to Joseph M. Heiberger et al. ("Heiberger"), filed Feb. 1, 2019, 27 pages.
Exhibit B-5 Belvac's Invalidity Contentions, Invalidity Chart for U.S. Pat. No. 9,968,982 ("the '982 Patent") U.S. Pat. No. 6,698,265 to Keith A. Thomas ("Thomas"), filed Feb. 1, 2019, 19 pages.
Exhibit B-4 Belvac's Invalidity Contentions, Invalidity Chart for U.S. Pat. No. 9,968,982 ("the '982 Patent") U.S. Pat. No. 7,404,309 ("Schill '309"), filed Feb. 1, 2019, 29 pages.
Exhibit B-2 Belvac's Invalidity Contentions, Invalidity Chart for U.S. Pat. No. 9,968,982 ("the '982 Patent") WO 97/37786 to Geoffrey Bowlin ("Bowlin '786"), filed Feb. 1, 2019, 28 pages.

(56) References Cited

OTHER PUBLICATIONS

Exhibit A-6 Belvac's Invalidity Contentions, Invalidity Chart for U.S. Pat. No. 9,308,570 ("the '570 Patent") U.S. Publication No. 2005/0193796 to Joseph M. Heiberger et al. ("Heiberger"), filed Feb. 1, 2019, 29 pages.
Exhibit A-5 Belvac's Invalidity Contentions, Invalidity Chart for U.S. Pat. No. 9,308,570 ("the '570 Patent") U.S. Pat. No. 6,698,265 to Keith A. Thomas ("Thomas"), filed Feb. 1, 2019, 18 pages.
"595 Tooling Envelope and Parameters", Belvac Production Machinery, Inc., DWG No. 2001229, Sep. 23, 2010, 1 page.
"Randolph", The Canmaker, Jan. 1995, 1 page.
"Reynolds New 'F Series' Spin Flow Necker", The Canmaker, Apr. 1996, 4 pages.
"European beverage can cupping press revealed", https://www.canmaker.com/online/european-beverage-can-cupping-press-revealed/, Mar. 2007, 1 page.

HIGH SPEED NECKING CONFIGURATION

CROSS REFERENCE TO RELATED APPLICATIONS

This application is a continuation of application Ser. No. 15/088,691, filed Apr. 1, 2016, which is a continuation of application Ser. No. 14/070,954, filed Nov. 4, 2013, now U.S. Pat. No. 9,308,570, which is a continuation of application Ser. No. 12/109,176, filed Apr. 24, 2008, now U.S. Pat. No. 8,601,843, and is related by subject matter to the inventions disclosed in the following commonly assigned applications: U.S. patent application Ser. No. 12/109,031, filed on Apr. 24, 2008 and entitled "Apparatus For Rotating A Container Body", now issued U.S. Pat. No. 7,997,111, U.S. patent application Ser. No. 12/108,950 filed on Apr. 24, 2008 and entitled "Adjustable Transfer Assembly For Container Manufacturing Process", now U.S. Pat. No. 8,245,551, U.S. patent application Ser. No. 12/109,058, filed on Apr. 24, 2008 and entitled "Distributed Drives for A Multi-Stage Can Necking Machine", now U.S. Pat. No. 8,464,567, U.S. patent application Ser. No. 12/108,926, filed on Apr. 24, 2008 and entitled "Container Manufacturing Process Having Front-End Winder Assembly", now U.S. Pat. No. 7,770,425, and U.S. patent application Ser. No. 12/109,131, filed on Apr. 24, 2008 and entitled "Systems And Methods For Monitoring And Controlling A Can Necking Process," now U.S. Pat. No. 7,784,319. The disclosure of each application is incorporated by reference herein in its entirety.

FIELD OF THE TECHNOLOGY

The present technology relates to a multi-stage can necking machine. More particularly, the present technology relates to a horizontal multi-stage can necking machine configured for high speed operations.

BACKGROUND

Metal beverage cans are designed and manufactured to withstand high internal pressure—typically 90 or 100 psi. Can bodies are commonly formed from a metal blank that is first drawn into a cup. The bottom of the cup is formed into a dome and a standing ring, and the sides of the cup are ironed to a desired can wall thickness and height. After the can is filled, a can end is placed onto the open can end and affixed with a seaming process.

It has been conventional practice to reduce the diameter at the top of the can to reduce the weight of the can end in a process referred to as necking. Cans may be necked in a "spin necking" process in which cans are rotated with rollers that reduce the diameter of the neck. Most cans are necked in a "die necking" process in which cans are longitudinally pushed into dies to gently reduce the neck diameter over several stages. For example, reducing the diameter of a can neck from a conventional body diameter of $2\frac{11}{16}^{th}$ inches to $2\frac{5}{16}^{th}$ inches (that is, from a 211 to a 206 size) often requires multiple stages, often 14.

Each of the necking stages typically includes a main turret shaft that carries a starwheel for holding the can bodies, a die assembly that includes the tooling for reducing the diameter of the open end of the can, and a pusher ram to push the can into the die tooling. Each necking stage also typically includes a transfer starwheel shaft that carries a starwheel to transfer cans between turret starwheels.

Multi-stage can necking machines are limited in speed. Typically, commercial machines run at a rate of 1200-2500 cans per minute. While this is a high rate, there is a constant need to produce more and more cans per minute.

Also, concentricity of cans is important. A small misalignment at the beginning of the necking stages may result in concentricity problems between the can body and neck. For illustration, a difference in the centers of 0.020 inches (twenty thousandths) could result in a weak seam or even result in an insufficiently seamed can.

SUMMARY

A horizontal can necking machine assembly may include a plural of main turrets and a plural of transfer starwheels. Each main turret may include a main turret shaft, a main gear mounted proximate to an end of the main turret shaft, a pusher assembly, and a die capable of necking a can body upon actuation of the turret shaft. Each transfer starwheel may include a transfer shaft and a transfer gear mounted proximate to an end of the transfer shaft. The transfer starwheels may be located in an alternating relationship with the main turrets, and the main gears may be engaged with the transfer gears such that lines through the main gear center and the centers of opposing transfer gears form an included angle of less than 170 degrees, thereby increasing the angular range available for necking the can body. The saw tooth configuration of turret and transfer shafts that provides this included angle yields, compared with configurations defining a 180 degree included angle, increased can residence time in the operational zone for a given rotational speed, which increased time enables longer or slower spindle stroke, and/or higher can throughput for a given residence time, or a combination thereof. In this regard, the main turrets and transfer starwheels may be operative to neck and move at least 2800 cans per minute, and each pusher assembly may have a stroke length relative to the die that is at least 1.5 inches, and preferably 3400 cans per minute at a stroke length of 1.75 inches.

A die for necking a can body may include a neck portion, a body portion, and a transition portion. The necking portion may have an inner wall that defines a cylinder having a first diameter. The body portion may have an inner wall that defines a cylinder having a second diameter. The transition portion may have an inner wall that smoothly transitions from the inner wall of the neck portion to the inner wall of the body portion. The first diameter is larger than the second diameter, and the neck portion is at least 0.125 inches long, and preferably 0.375 inches long.

DETAILED DESCRIPTION OF ILLUSTRATIVE EMBODIMENTS

A preferred configuration for driving a multi-stage can necking machine is provided. The multi-stage can necking machine incorporates technology that overcomes the many shortcomings of known multi-stage can necking machines. The present invention is not limited to the disclosed configuration, but rather encompasses use of the technology disclosed, in any manufacturing application according to the language of the claims.

Figure 1:
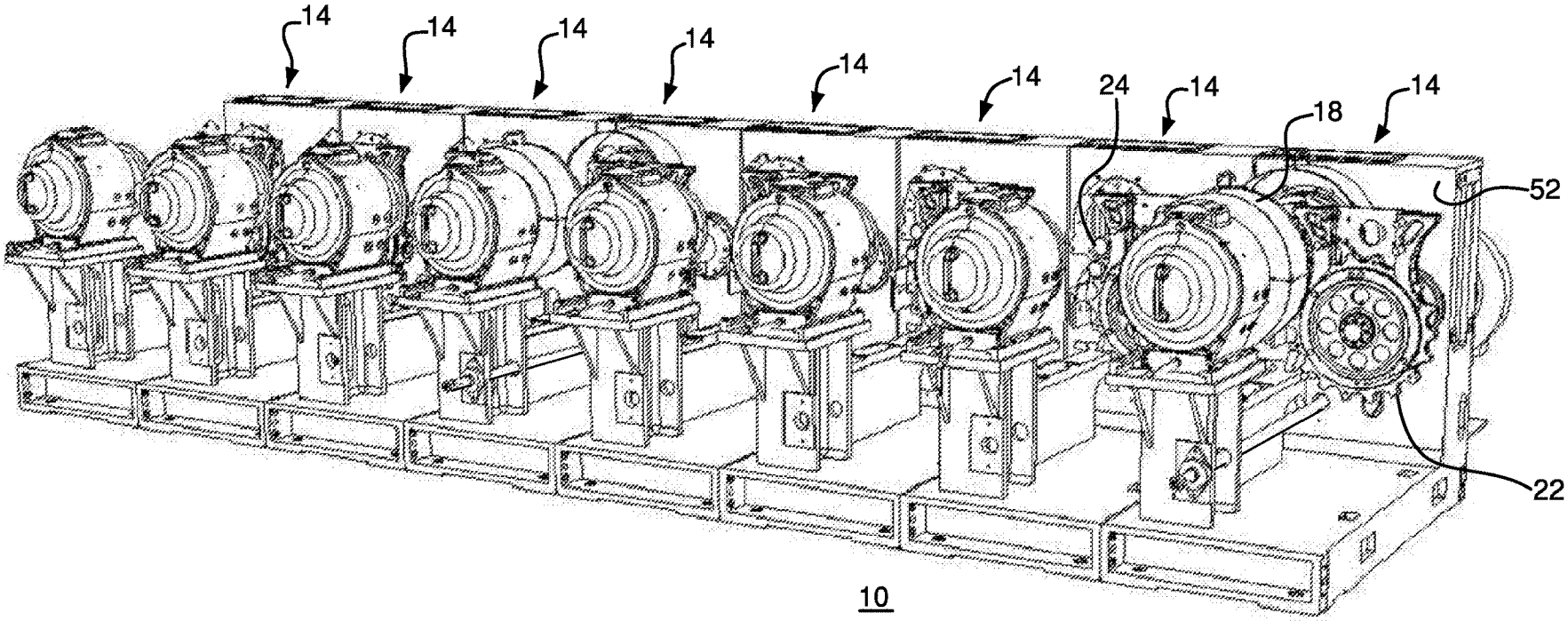
FIG. 1 is a perspective view depicting a multi-stage can necking machine.

As shown in FIG. 1, a multi-stage can necking machine 10 may include several necking stages 14. Each necking stage 14 includes a necking station 18 and a transfer starwheel 22. Each one of the necking stations 18 is adapted to incrementally reduce the diameter of an open end of a can body, and the transfer starwheels 22 are adapted to transfer the can body between adjacent necking stations 18, and optionally at the inlet and outlet of necking machine 10. Conventional multi-stage can necking machines, in general, include an input station and a waxer station at an inlet of the necking stages, and optionally include a bottom reforming station, a flanging station, and a light testing station positioned at an outlet of the necking stages. Accordingly, multi-stage can necking machine 10, may include in addition to necking stages 14, other operation stages such as an input station, a bottom reforming station, a flanging station, and a light testing station of the type that are found in conventional multi-stage can necking machines (not shown). The term "operation stage" or "operation station" and its derivative is used herein to encompass the necking station 14, bottom reforming station, a flanging station, and a light testing station, and the like. Preferably, multi-stage can necking machine 10 is operative to neck and move at least 2800 cans per minute, more preferably at least 3200 cans per minute, and even more preferably at least 3400 cans per minute.

Figure 2:
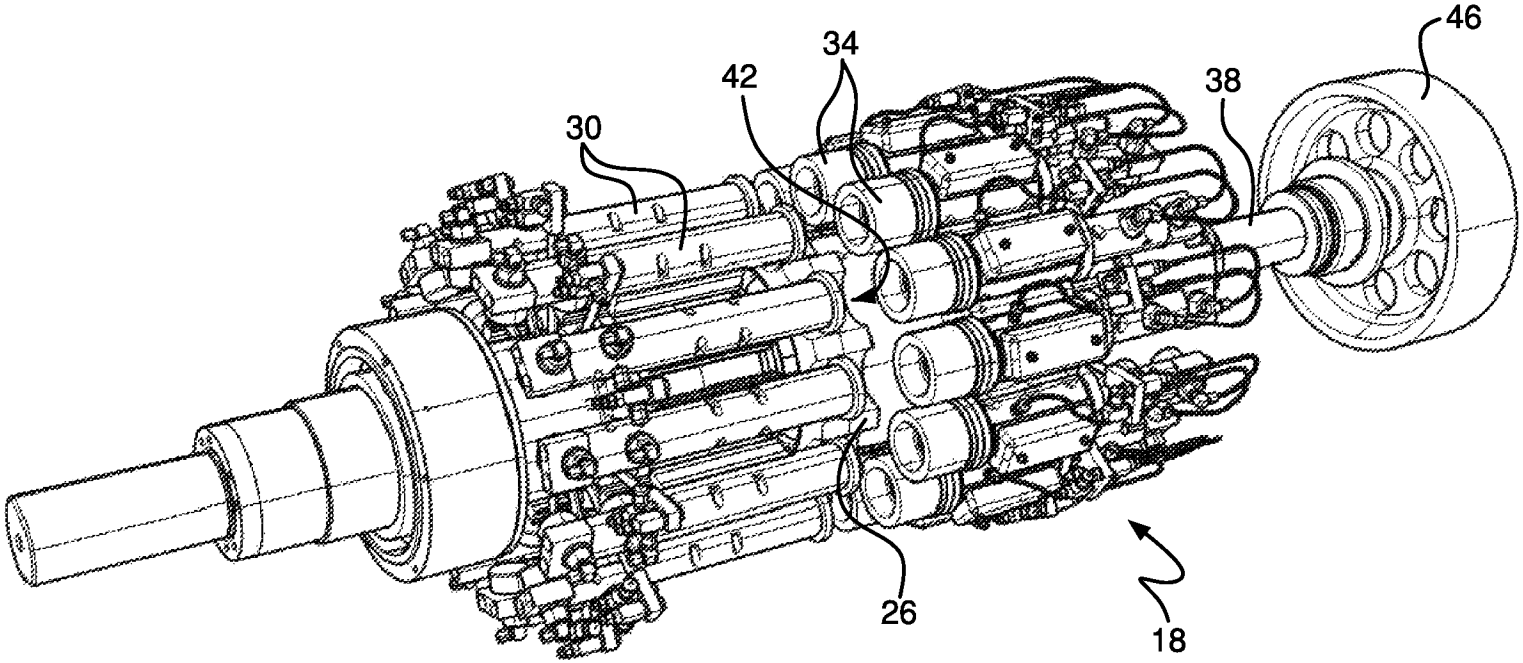
FIG. 2 is a perspective view depicting a necking station and gear mounted on a main turret shaft of the multi-stage necking machine shown in FIG. 1, with surrounding and supporting parts removed for clarity.

FIG. 2 is a detailed view depicting operative parts of one of the necking stations 18. As shown, each necking station 18 includes a main turret 26, a set of pusher rams 30, and a set of dies 34. The main turret 26, the pusher rams 30, and the dies 34 are each mounted on a main turret shaft 38. As shown, the main turret 26 has a plurality of pockets 42 formed therein. Each pocket 42 has a pusher ram 30 on one side of the pocket 42 and a corresponding die 34 on the other side of the pocket 42. In operation, each pocket 42 is adapted to receive a can body and securely holds the can body in place by mechanical means, such as by the action pusher ram and the punch and die assembly, and compressed air, as is understood in the art. During the necking operation, the open end of the can body is brought into contact with the die 34 by the pusher ram 30 as the pocket 42 on main turret 26 carries the can body through an arc along a top portion of the necking station 18.

Die 34, in transverse cross section, is typically designed to have a lower cylindrical surface with a dimension capable of receiving the can body, a curved or angled transition zone, and a reduced diameter (relative to the lower cylindrical surface) upper cylindrical surface above the transition zone. During the necking operation, the can body is moved up into die 34 such that the open end of the can body is placed into touching contact with the transition zone of die 34. As the can body is moved further upward into die 34, the upper region of the can body is forced past the transition zone into a snug position between the inner reduced diameter surface of die 34 and a form control member or sleeve located at the lower portion of pusher ram 30. The diameter of the upper region of the can is thereby given a reduced dimension by die 34. A curvature is formed in the can wall corresponding to the surface configuration of the transition zone of die 34. The can is then ejected out of die 34 and transferred to an adjacent transfer starwheel. U.S. Pat. No. 6,094,961, which is incorporated herein by reference, discloses an example necking die used in can necking operations.

As best shown in FIG. 2, a main turret gear 46 (shown schematically in FIG. 2 without teeth) is mounted proximate to an end of shaft 38. The gear 46 may be made of suitable material, and preferably is steel.

Figure 3:
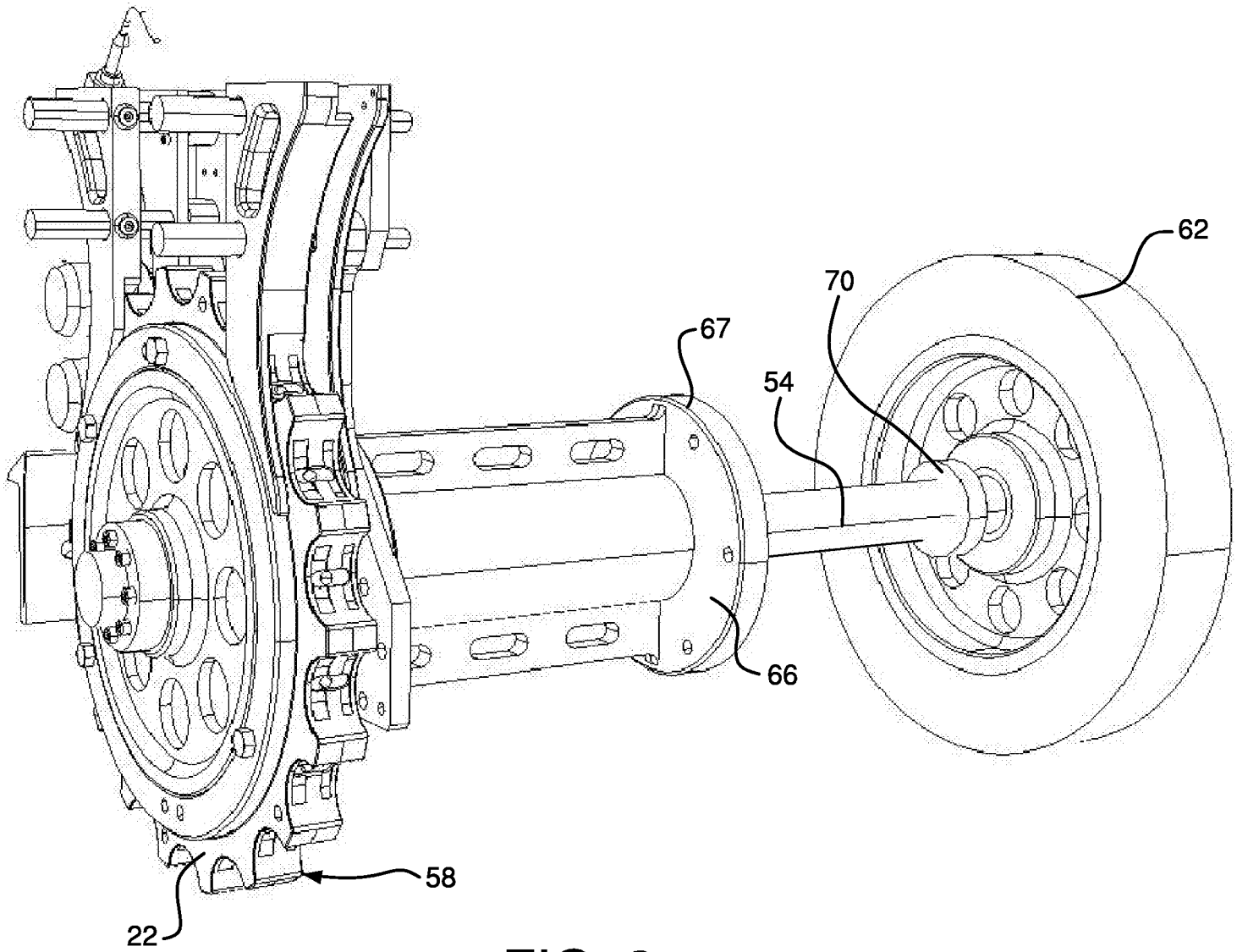
FIG. 3 is a perspective view depicting a transfer starwheel and gear mounted on a starwheel shaft of the multi-stage necking machine shown in FIG. 1, with surrounding and supporting parts removed for clarity.

As shown in FIG. 3, each starwheel 22 may be mounted on a shaft 54, and may include several pockets 58 formed therein. The starwheels 22 may have any amount of pockets 58. For example each starwheel 22 may include twelve pockets 58 or even eighteen pockets 58, depending on the particular application and goals of the machine design. Each pocket 58 is adapted to receive a can body and retains the can body using a vacuum force. The vacuum force should be strong enough to retain the can body as the starwheel 22 carries the can body through an arc along a bottom of the starwheel 22.

As shown, a gear 62 (shown schematically in FIG. 3 without teeth) is mounted proximate to an end of the shaft 54. Gear 62 may be made of steel but preferably is made of a composite material. For example, each gear 62 may be made of any conventional material, such as a reinforced plastic, such as Nylon 12.

As also shown in FIG. 3, a horizontal structural support 66 supports transfer shaft 54. Support 66 includes a flange at the back end (that is, to the right of FIG. 3) for bolting to an upright support of the base of machine 10 and includes a bearing (not shown in FIG. 3) near the front end inboard of the transfer starwheel 22. Accordingly, transfer starwheel shaft 54 is supported by a back end bearing 70 that preferably is bolted to upright support 52 and a front end bearing that is supported by horizontal support 66, which itself is cantilevered from upright support 52. Preferably the base and upright support 52 is a unitary structure for each operation stage.

Figure 4:
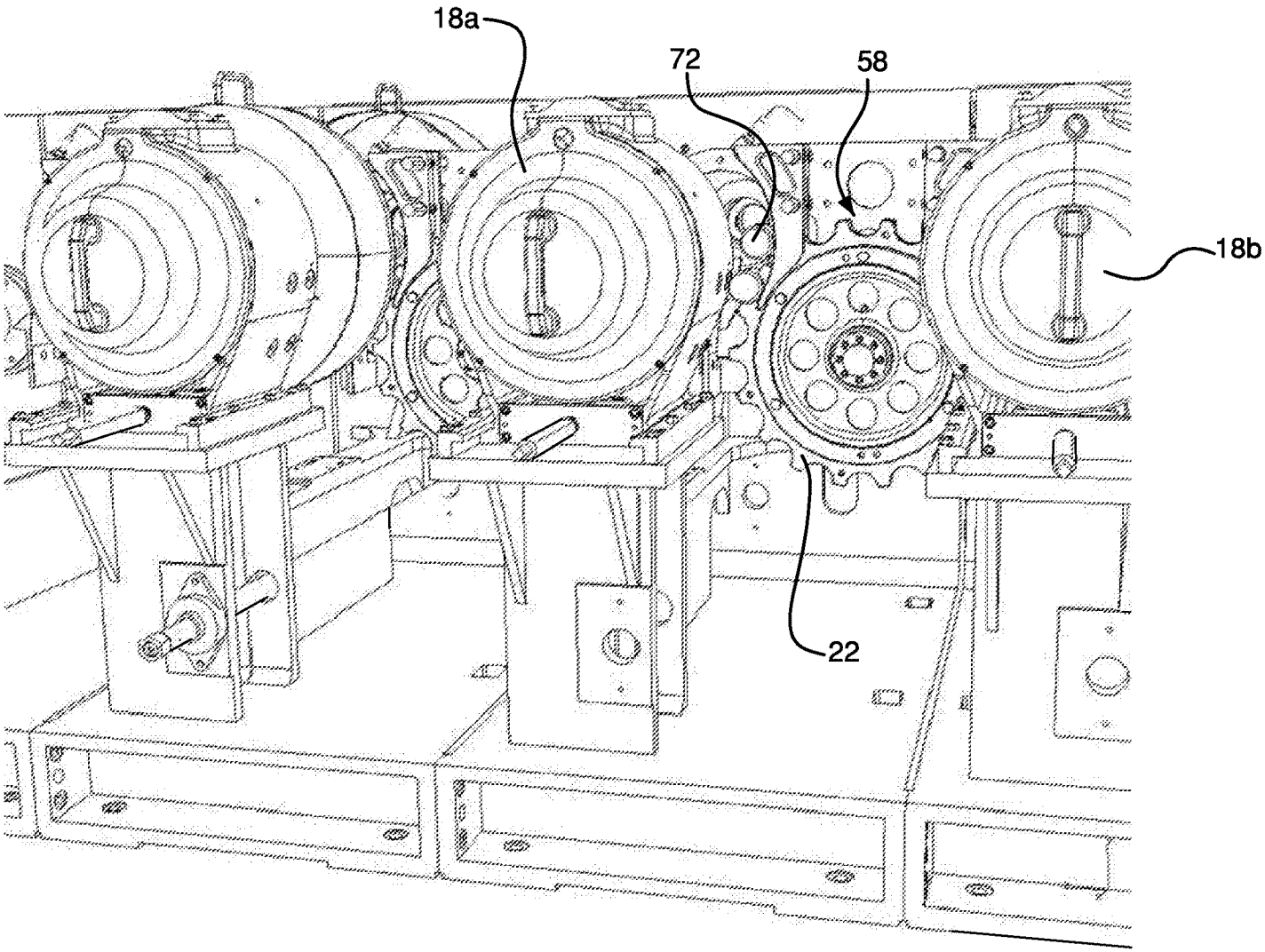
FIG. 4 is a partial expanded view depicting a section of the multi-stage can necking machine shown in FIG. 1.

FIG. 4 illustrates a can body 72 exiting a necking stage and about to transfer to a transfer starwheel 22. After the diameter of the end of a can body 72 has been reduced by the first necking station 18*a* shown in the middle of FIG. 4, main turret 26 of the necking station 18*a* deposits the can body into a pocket 58 of the transfer starwheel 22. The pocket 58 then retains the can body 72 using a vacuum force that is induced into pocket 58 from the vacuum system described in U.S. Pat. No. 8,245,551, filed as co-pending application U.S. Ser. No. 12/108,950, which is incorporated herein by reference in its entirety, carries the can body 72 through an arc over the bottommost portion of starwheel 22, and deposits the can body 72 into one of the pockets 42 of the main turret 26 of an adjacent necking station 18*b*. The necking station 18*b* further reduces the diameter of the end of the can body 72 in a manner substantially identical to that noted above.

Machine 10 may be configured with any number of necking stations 18, depending on the original and final neck diameters, material and thickness of can 72, and like parameters, as understood by persons familiar with can necking technology. For example, multi-stage can necking machine 10 illustrated in the figures includes eight stages 14, and each stage incrementally reduces the diameter of the open end of the can body 72 as described above.

Figure 5:
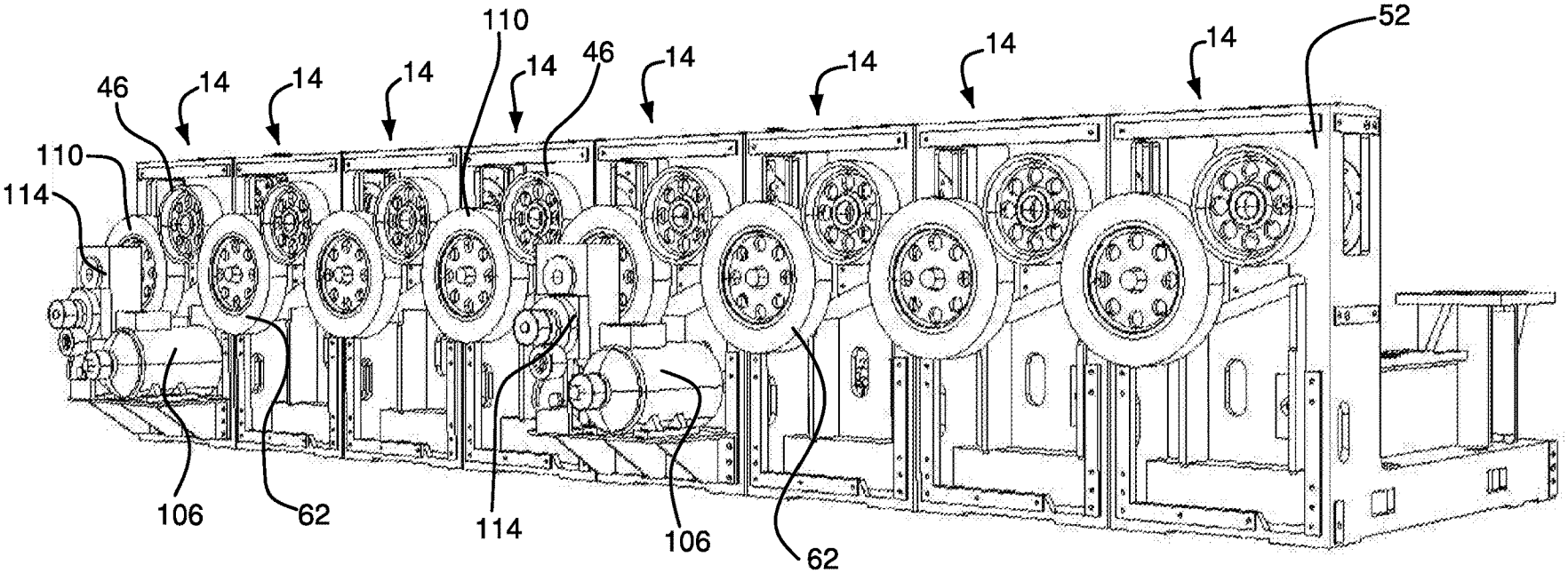
FIG. 5 is a perspective view depicting a back side of a multi-stage can necking machine having distributed drives.

As shown in FIG. 5, when the shafts 38 and 54 are supported near their rear ends by upright support 52, and the ends of the shafts 38 and 54 preferably are cantilevered such that the gears 46 and 62 are exterior to the supports 52. A cover (not shown) for preventing accidental personnel contact with gears 46 and 62, may be located over gears 46 and 62. As shown, the gears 46 and 62 are in mesh communication to form a continuous gear train. The gears 46 and 62 preferably are positioned relative to each other to define a zig-zag or saw tooth configuration. That is, the main gears 46 are engaged with the transfer starwheel gears 62 such that lines through the main gear 46 center and the centers of opposing transfer starwheel gears 62 form an included angle of less than 170 degrees, preferably approximately 120 degrees, thereby increasing the angular range available for necking the can body. In this regard, because the transfer starwheels 22 have centerlines below the centerlines of main turrets 26, the operative portion of the main turret 26 (that is, the arc through which the can passes during which the necking or other operation can be performed) is greater than 180 degrees on the main turret 26, which for a given rotational speed provides the can with greater time in the operative zone. Accordingly the operative zone has an angle (defined by the orientation of the centers of shafts 38 and 54) greater than about 225 degrees, and even more preferably, the angle is greater than 240 degrees. The embodiment shown in the figures has an operative zone having an angle of 240 degrees. In general, the greater the angle that defines the operative zone, the greater the angular range available for necking the can body.

In this regard, for a given rotational speed, the longer residence time of a can in the operative zone enables a longer stroke length for a given longitudinal speed of the pusher ram. For example, with the above identified configuration, the pusher ram 30 may have a stroke length relative to the die 34 of at least 1.5 inches. Preferably, the pusher ram 30 will have a stroke length relative to the die 34 of at least 1.625 inches and even more preferably the stroke length is at least 1.75 inches. For the embodiment shown in the figures, the stroke length is approximately 1.75 inches.

Figure 6A:
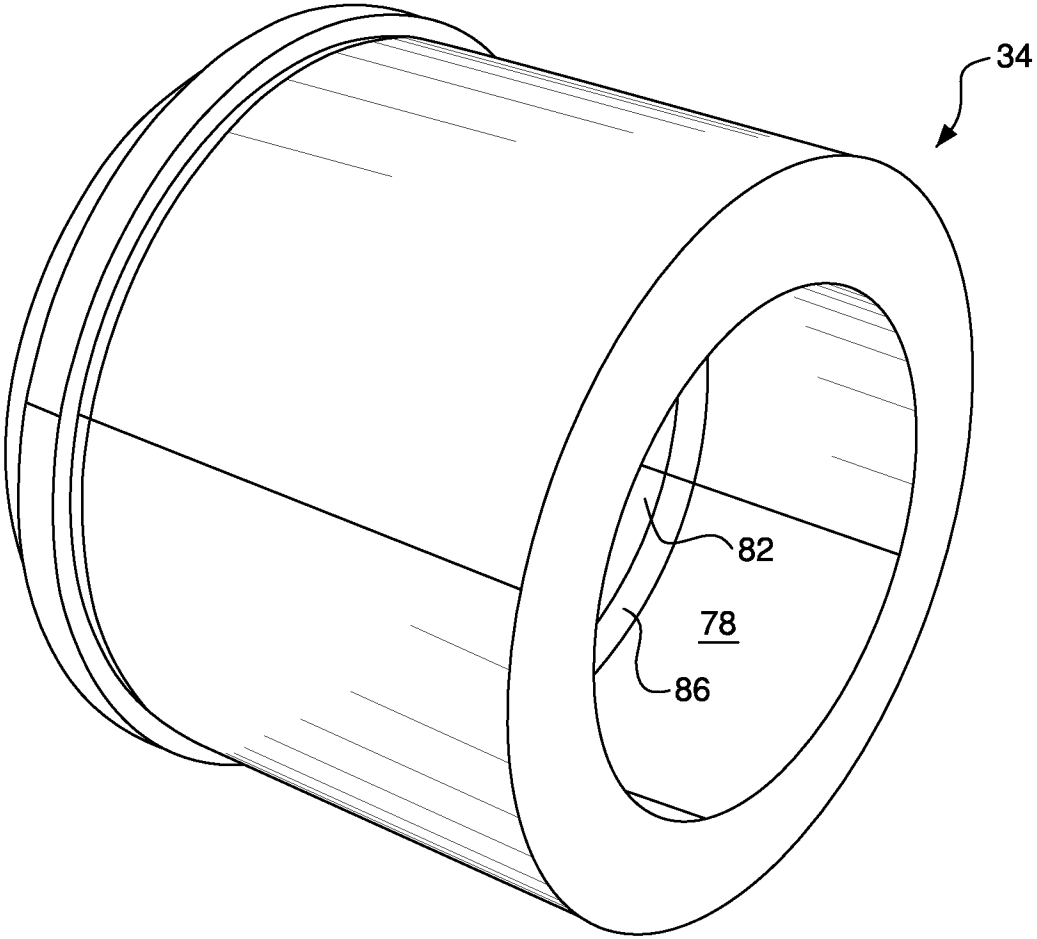
FIG. 6A is a perspective view depicting a forming die.
Figure 6B:
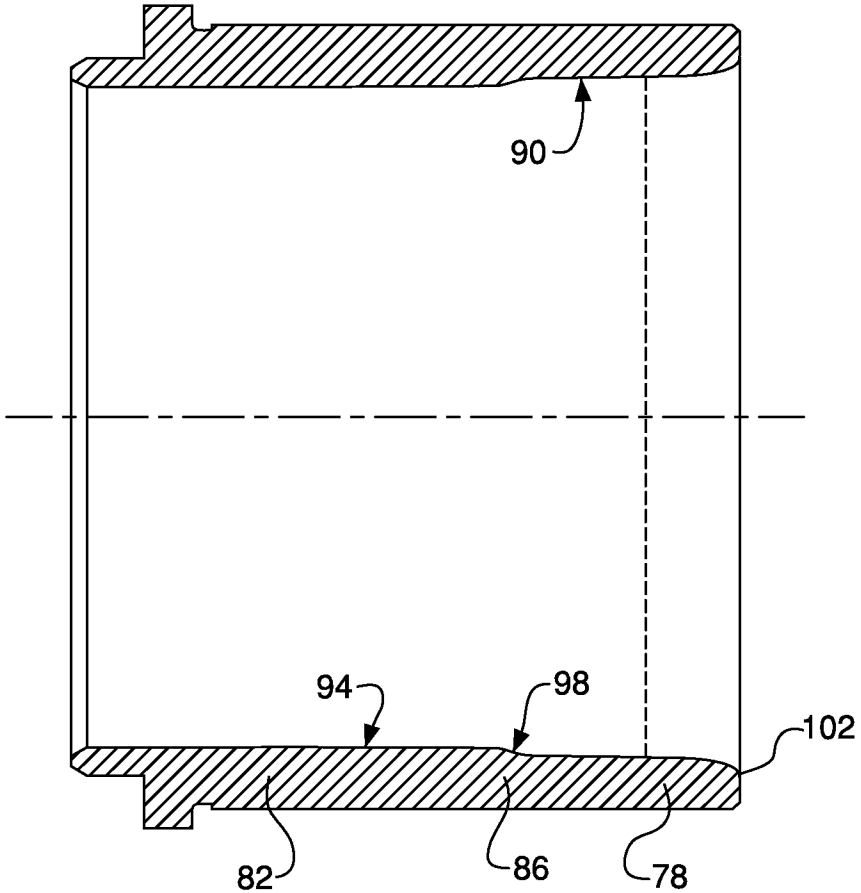
FIG. 6B is a cross-sectional view of the forming die depicted in FIG. 6A.

The angular range available for necking of greater than 180 degrees enables the die used to reduce the diameter of the end of the can body to be designed to improve the concentricity of the can end. As shown in FIGS. 6A and 6B, the die 34 includes a throat portion 78, a body portion 82 and a transition portion 86. As shown, the throat portion 78 has an inner surface 90 that defines a cylinder having a first diameter, the body portion 82 has an inner surface 94 that defines a cylinder having a second diameter, and the transition portion 86 has an inner surface 98 that extends smoothly (and may be curved) from the inner surface 90 of the throat portion 78 to the inner surface 94 of the body portion 82. The first diameter should be large enough to receive the can body and the second diameter should be sized so that the diameter of the end of the can body can be reduced to a desired diameter.

To help improve the concentricity of the can end the throat portion preferably has a length of at least 0.125 inches, more preferably a length of at least 0.25 inches and even more preferably a length of at least 0.375 inches. The embodiment illustrated in the figures has a throat length of approximately 0.375 inches. Furthermore, an inlet 102 of the throat portion 78 may be rounded.

During operation of conventional stroke machines, the first part of the can that touches the die is the neck or necked rim. Any error in the neck portion often becomes worse, throughout the necking stages. In the long stroke machine illustrated herein, when the can goes into the die, it first locates itself in the die before it touches the transition portion. Therefore, by having a longer throat portion 78 compared with the prior art, the die 34 is able to center the can body prior to necking. Additionally, by having a longer throat portion 78, the die 34 is able to seal the compressed air sooner. Until the can is sealed, the compresses air blows into the ambient atmosphere, which can be costly.

Referring back to FIG. 5, the multi-stage can necking machine 10 may include several motors 106 to drive the gears 46 and 62 of each necking stage 14. As shown, there preferably is one motor 106 per every four necking stages 14, as generally described in U.S. Pat. No. 8,464,567, filed as copending application U.S. Ser. No. 12/109,058, which is incorporated herein by reference in its entirety. Each motor 106 is coupled to and drives a first gear 110 by way of a gear box 114. The motor driven gears 110 then drive the remaining gears of the gear train. By using multiple motors 106, the torque required to drive the entire gear train can be distributed throughout the gears, as opposed to prior art necking machines that use a single motor to drive the entire gear train. In the prior art gear train that is driven by a single gear, the gear teeth must be sized according to the maximum stress. Because the gears closest to the prior art drive gearbox must transmit torque to the entire gear train (or where the single drive is located near the center on the stages, must transmit torque to about half the gear train), the maximum load on prior art gear teeth is higher than the maximum tooth load of the distributed gearboxes according to the present invention. The importance in this difference in tooth loads is amplified upon considering that the maximum loads often occur in emergency stop situations. A benefit of the lower load or torque transmission of gears 46 and 62 compared with that of the prior art is that the gears can be more readily and economically formed of a reinforced thermoplastic or composite, as described above. Lubrication of the synthetic gears can be achieved with heavy grease or like synthetic viscous lubricant, as will be understood by persons familiar with lubrication of gears of necking or other machines, even when every other gear is steel as in the presently illustrated embodiment. Accordingly, the gears are not required to be enclosed in an oil-tight chamber or an oil bath, but rather merely require a minimal protection against accidental personnel contact.

Each motor 106 is driven by a separate inverter which supplies the motors 106 with current. To achieve a desired motor speed, the frequency of the inverter output is altered, typically between zero to 50 (or 60 hertz). For example, if the motors 106 are to be driven at half speed (that is, half the rotational speed corresponding to half the maximum or rated throughput) they would be supplied with 25 Hz (or 30 Hz).

Figure 7:
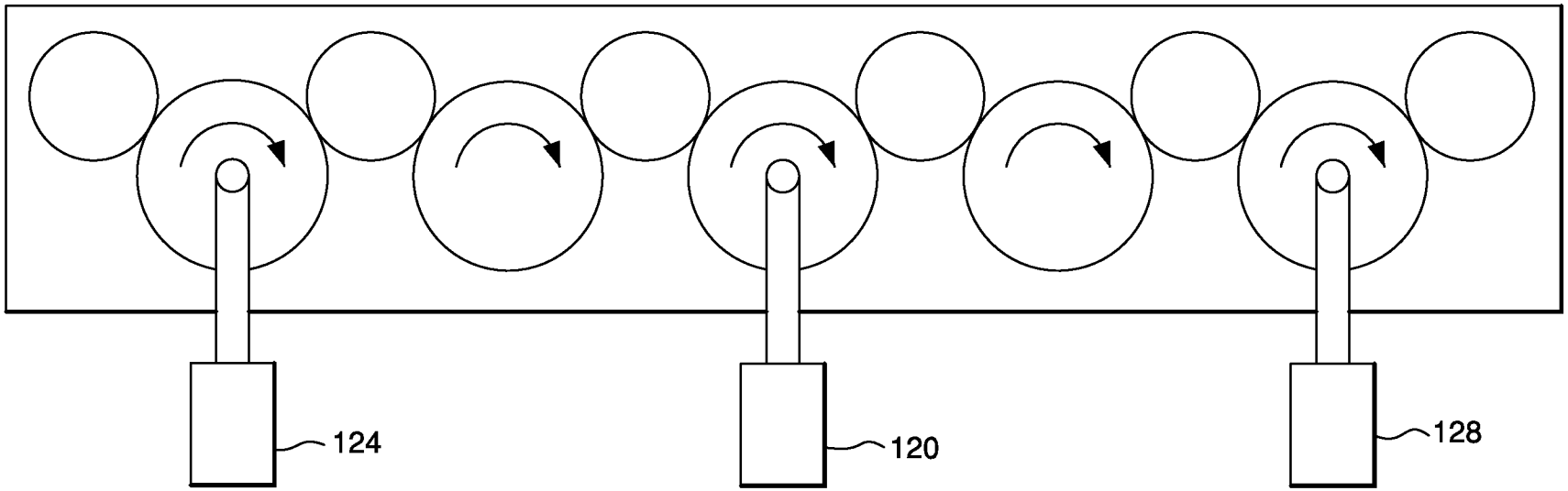
FIG. 7 is a schematic illustrating a machine having distributed drives.

In the case of the distributed drive configuration shown herein, each motor inverter is set at a different frequency. Referring to FIG. 7 for example, a second motor 120 may have a frequency that is approximately 0.02 Hz greater than the frequency of a first motor 124, and a third motor 128 may have a frequency that is approximately 0.02 Hz greater than the frequency of the second motor 120. It should be understood that the increment of 0.02 Hz may be variable, however, it will be by a small percentage (in this case less than 1%).

Figure 8:
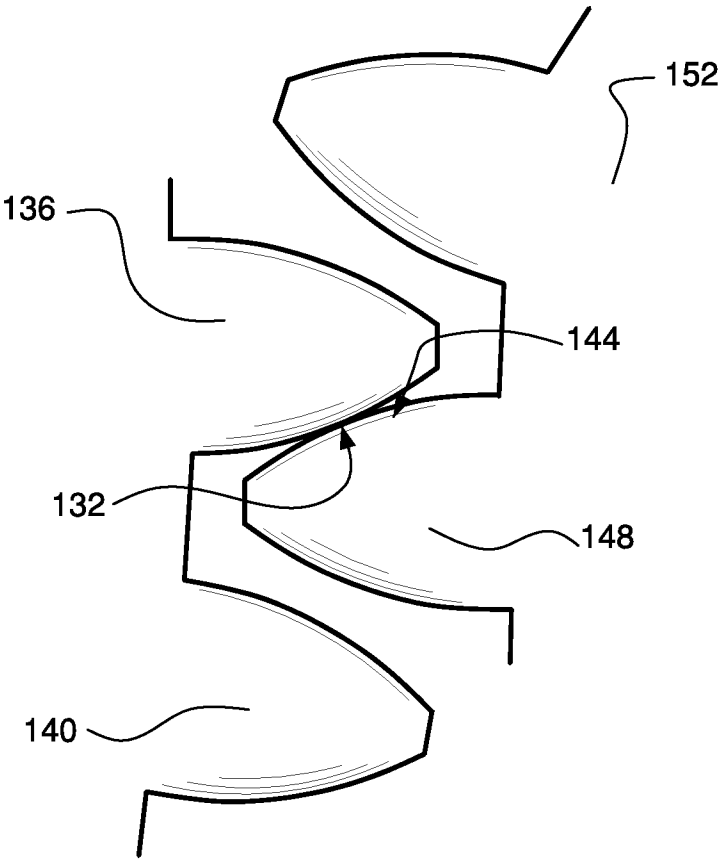
FIG. 8 is a partial expanded view depicting gear teeth from adjacent gears engaging each other.

The downstream motors preferably are preferably controlled to operate at a slightly higher speed to maintain contact between the driving gear teeth and the driven gear teeth throughout the gear train. Even a small freewheeling effect in which a driven gear loses contact with its driving gear could introduce a variation in rotational speed in the gear or misalignment as the gear during operation would not be in its designed position during its rotation. Because the operating turrets are attached to the gear train, variations in rotational speed could produce misalignment as a can 72 is passed between starwheel and main turret pockets and variability in the necking process. The actual result of controlling the downstream gears to operate a slightly higher speed is that the motors 120, 124, and 128 all run at the same speed, with motors 120 and 128 "slipping," which should not have any detrimental effect on the life of the motors. Essentially, motors 120 and 128 are applying more torque, which causes the gear train to be "pulled along" from the direction of motor 128. Such an arrangement eliminates variation in backlash in the gears, as they are always contacting on the same side of the tooth, as shown in FIG. 8. As shown in FIG. 8, a contact surface 132 of a gear tooth 136 of a first gear 140 may contact a contact surface 144 of a gear tooth 148 of a second gear 152. This is also true when the machine starts to slow down, as the speed reduction is applied in the same way (with motor 128 still being supplied with a higher frequency). Thus "chattering" between the gears when the machine speed changes may be avoided.

In the case of a machine using one motor, reductions in speed may cause the gears to drive on the opposite side of the teeth. It is possible that this may create small changes in the relationship between the timing of the pockets passing cans from one turret to the next, and if this happens, the can bodies may be dented.

The present invention has been described by illustrating preferred embodiments. The present invention is not limited to an configuration or dimensions provided in the specification, but rather should be entitled to the full scope as defined in the claims.

What is claimed:

1. A horizontal beverage can necking machine for forming necked beverage can bodies suitable for forming a seam with a beverage can end, the assembly comprising:

multiple horizontal necking stages adapted for necking at least 3000 beverage can bodies per minute, each necking stage being configured to rotate about a respective axis that is substantially parallel to a surface on which the necking machine is supported;

the longitudinal centers of the adjacent necking stages forming an included angle with the longitudinal center of a transfer starwheel, measured with the longitudinal center of the transfer starwheel at the vertex, of no more than 170 degrees;

each one of the necking stages including a main turret that includes: a main turret shaft, a main turret starwheel having plural pockets adapted for carrying can bodies, and a main gear adapted for receiving torque to rotate the main turret shaft; each one of the pockets having a necking die at one end thereof and a pad on an opposing end;

each necking die comprising:

a throat portion having an inner surface that defines a cylinder having a throat portion diameter;

a body portion having an inner surface that defines a cylinder having a body portion diameter; and a transition portion having an inner surface that smoothly transitions from the inner surface of the throat portion to the inner surface of the body portion, wherein the throat portion diameter is larger than the body portion diameter; and each one of the pockets of each one of the necking stages having a first configuration in which the can body is spaced apart from the necking die and a second configuration in which the can body is engaged with the necking die; in the first configuration the pad is spaced apart from the necking die by a first distance, in the second configuration the pad is spaced apart from the necking die by a second distance that is at least 1.75 inches less than the first distance;

whereby the throat portion inner surface is adapted for enhancing concentricity of the can body relative to the die.

2. The horizontal beverage can necking machine of claim 1 wherein the longitudinal centers of the adjacent necking stages form the included angle with the longitudinal center of the transfer starwheel of no more than 120 degrees.

3. The horizontal beverage can necking machine of claim 2 wherein the pad is part of a pusher assembly adapted for moving the pad toward the necking die.

4. The horizontal can necking machine of claim 2, wherein the throat portion is at least 0.25 inches long.

5. The horizontal can necking machine of claim 4 wherein the included angle of no more than 120 degrees thereby increases the angular range available for necking the can body.

6. The horizontal beverage can necking machine of claim 5 wherein the necking stages are adapted for necking at least 3200 beverage can bodies per minute.

7. The horizontal beverage can necking machine of claim 5 wherein the necking stages are adapted for necking at least 3400 beverage can bodies per minute.

8. The horizontal can necking machine of claim 2, wherein the throat portion is approximately 0.375 inches long.

9. The horizontal can necking machine of claim 8 wherein the included angle of no more than 120 degrees thereby increases the angular range available for necking the can body.

10. The horizontal beverage can necking machine of claim 9 wherein the necking stages are adapted for necking at least 3200 beverage can bodies per minute.

11. The horizontal beverage can necking machine of claim 9 wherein the necking stages are adapted for necking at least 3400 beverage can bodies per minute.

12. The horizontal can necking machine of claim 2 wherein the pad is adapted for being moved toward the necking die.

13. The horizontal beverage can necking machine of claim 1 wherein the necking stages are adapted for necking at least 3200 beverage can bodies per minute.

14. The horizontal beverage can necking machine of claim 1 wherein the necking stages are adapted for necking at least 3400 beverage can bodies per minute.

15. The horizontal beverage can necking machine of claim 1 wherein for each necking stage the main gear is mounted on the main turret shaft.

16. The horizontal can necking machine of claim 1, wherein the throat portion is rounded proximate to an inlet of the throat portion.

* * * * *